US010145079B1

(12) United States Patent
Swenson et al.

(10) Patent No.: US 10,145,079 B1
(45) Date of Patent: Dec. 4, 2018

(54) BERM AND METHOD OF MANUFACTURING A BERM

(71) Applicant: AWT IP, LLC, Glen Allen, VA (US)

(72) Inventors: John Paul Swenson, Glen Allen, VA (US); Scott K. Sheridan, Richmond, VA (US); Carlton Dudding, Glen Allen, VA (US)

(73) Assignee: AWT IP LLC, Glen Allen, VA (US)

( * ) Notice: Subject to any disclaimer, the term of this patent is extended or adjusted under 35 U.S.C. 154(b) by 0 days.

(21) Appl. No.: 15/799,047

(22) Filed: Oct. 31, 2017

(51) Int. Cl.
*E02D 17/18* (2006.01)
*E02D 17/20* (2006.01)

(52) U.S. Cl.
CPC ..... *E02D 17/18* (2013.01); *E02D 17/202* (2013.01)

(58) Field of Classification Search
USPC ... 405/129.45, 129.55, 129.6, 129.75, 129.9, 405/129.95
See application file for complete search history.

(56) References Cited

U.S. PATENT DOCUMENTS 3,234,741 A 2/1966 Ionides
3,383,864 A 5/1968 Turzillo
3,421,326 A 1/1969 Vidal
3,705,851 A 12/1972 Brauer
4,050,254 A 9/1977 Meheen
4,117,686 A 10/1978 Hilfiker
4,125,970 A 11/1978 Vidal
4,166,709 A 9/1979 Valiga
4,268,993 A 5/1981 Cunningham
4,287,141 A 9/1981 Russell
4,521,131 A 6/1985 Nandlal
4,526,615 A 7/1985 Johnson
4,555,201 A 11/1985 Paoluccio
4,596,491 A 6/1986 Dietzler
4,655,637 A 4/1987 Vignocchi
4,668,129 A 5/1987 Babcock
4,818,151 A 4/1989 Moreland
(Continued)

OTHER PUBLICATIONS

Connecticut Department of Environmental Protection, Clean Fill, Mar. 2009, All pages http://www.ct.gov/deep/lib/deep/waste_management_and_disposal/solid_waste_management_plan/revisingcleanfilldefinition.pdf (Year: 2009).*
(Continued)

*Primary Examiner* — Kyle Armstrong
(74) *Attorney, Agent, or Firm* — Patent Law of Virginia, PLLC; Brian J. Teague

(57) ABSTRACT

A berm comprises fill material having a sloped face portion, a plurality of reinforcing members disposed within the fill material, and an impermeable membrane encapsulating the fill material. The impermeable membrane is impermeable to fluid and comprises a plurality of joined impermeable membrane segments. The sloped face portion is encapsulated by at least a portion of each of two or more of the impermeable membrane segments. Where two impermeable membrane segments encapsulating the sloped face portion meet, an upper end portion of a lower one of the impermeable membrane segments extends into the fill material and a lower end portion of an upper one of the impermeable membrane segments overlaps the lower one of the impermeable membrane segments in a shingled fashion.

22 Claims, 2 Drawing Sheets

(56) References Cited

U.S. PATENT DOCUMENTS

| | | | | |
|---|---|---|---|---|
| 4,930,939 | A * | 6/1990 | Jaecklin | E02D 29/0241 405/262 |
| 4,992,003 | A | 2/1991 | Perach | |
| 5,044,833 | A | 9/1991 | Wilfiker | |
| 5,056,960 | A | 10/1991 | Marienfeld | |
| 5,066,169 | A | 11/1991 | Gavin | |
| 5,076,735 | A | 12/1991 | Hilfiker | |
| 5,139,369 | A | 8/1992 | Jaecklin | |
| 5,156,496 | A * | 10/1992 | Vidal | E02D 29/0241 405/262 |
| 5,276,255 | A | 1/1994 | Stark | |
| 5,401,118 | A * | 3/1995 | Kramer | E02D 31/004 405/129.45 |
| 5,419,659 | A | 5/1995 | Mercer | |
| 5,439,318 | A | 8/1995 | Stark | |
| 5,522,682 | A | 6/1996 | Egan | |
| 5,531,547 | A | 7/1996 | Shimada | |
| 5,549,418 | A | 8/1996 | Devine | |
| 5,599,139 | A | 2/1997 | Chewning | |
| 5,658,096 | A | 8/1997 | Von Kanel | |
| 5,707,183 | A | 1/1998 | Akamine | |
| 5,836,129 | A | 11/1998 | Jaecklin | |
| 5,857,807 | A | 1/1999 | Longo, Sr. | |
| 5,948,250 | A | 9/1999 | Middleton | |
| 5,961,437 | A | 10/1999 | Smith | |
| 6,238,144 | B1 | 5/2001 | Babcock | |
| 6,296,422 | B1 | 10/2001 | Ferraiolo | |
| 6,443,663 | B1 | 9/2002 | Scales | |
| 6,808,339 | B2 | 10/2004 | Peterson | |
| 6,824,681 | B2 | 11/2004 | Engwer | |
| 6,893,193 | B2 | 5/2005 | Santha | |
| 7,029,204 | B1 | 4/2006 | Webber | |
| 7,097,390 | B1 | 8/2006 | Moss | |
| 7,118,308 | B2 | 10/2006 | Hater | |
| 7,147,405 | B2 | 12/2006 | Ferraiolo | |
| 7,314,336 | B2 | 1/2008 | Moss | |
| 7,399,144 | B2 | 7/2008 | Kallen | |
| 7,469,859 | B1 | 12/2008 | Campbell | |
| 8,246,274 | B1 | 8/2012 | Hall | |
| 2003/0185634 | A1 | 10/2003 | Babcock | |
| 2003/0198521 | A1 * | 10/2003 | Chandler, Jr. | B09B 1/00 405/270 |
| 2004/0018061 | A1 | 1/2004 | Jansson | |
| 2004/0079699 | A1 | 4/2004 | Engwer | |
| 2005/0252144 | A1 | 11/2005 | MacDonald | |
| 2005/0271478 | A1 | 12/2005 | Ferraiolo | |
| 2009/0050025 | A1 | 2/2009 | Wissa | |
| 2009/0285640 | A1 | 11/2009 | Hilfiker | |
| 2011/0135403 | A1 * | 6/2011 | Dudding | E02D 31/002 405/272 |

OTHER PUBLICATIONS

Bacher et al., 'Coal Combustion Fly-Ash as Construction Material in a Sanitary Landfill Project,' Oct. 1996, Proceedings of Coal Combustion By-Products Associated with Coal Mining—Interactive Forum, 10 pages.

Conservation Approach to Coal Combustion Products Handling, MACTEC, 42 pages, available at http://conservationengineers.org/conferences/2010presentations/CoalConversion_Schmitt.pdf, undated.

Delaware Dept. of Natural Resources and Environmental Control, 'II. Municipal Solid Waste and Landfill Capacity in Delaware,' Nov. 2005, p. 12-58., available at http://www.dnrec.delaware.gov/SWMTVVG/Documents/2ac98919f32b4f269b135dfb50-4c3a3aDecember13BackgroundonMSWsituationinDelaware.pdf.

Kevin Robinson, Dayakar Penumadu, Douglas Brown, Nancy Roberts and Willie Liew; A New Large Volume Application for Beneficial Use of Coal Combustion Products in Hydrologically and Environmentally Responsible Engineered Landfill Containment Berms; 6 pages; Aug. 31, 2009.

* cited by examiner

BERM AND METHOD OF MANUFACTURING A BERM

CROSS-REFERENCE TO RELATED APPLICATIONS

This application is related to co-owned U.S. application Ser. No. 15/456,829, filed Mar. 13, 2017, the contents of which are incorporated herein by reference in its entirety.

FIELD OF THE INVENTION

The present invention generally relates to berms, such as used for containment, embankments, structures, etc.

BACKGROUND OF THE INVENTION

A berm is a raised barrier separating two spaces. Berms are commonly used for containment. Berms are commonly used in situations where the ability to construct vertically has been constrained by the inability to expand laterally at a slope that allows the desired vertical height to be attained without failure. For example, berms are often used to expand the capacity of landfills that are nearing or have reached their capacity, but which do not have space to expand outward. In such situations, berms may be constructed around some or all of the landfill to increase the vertical capacity.

Berms often comprise a reinforced portion and backfill material. The reinforced portion comprises structural fill material with reinforcing members disposed (typically substantially horizontally) therein. Facing baskets are typically attached to the reinforcing members to provide the needed structural strength. These berms allow for the desired vertical height in a limited space. These berms are very expensive to construct, however, on a relative basis, as material with very tight specifications must be acquired and transported and the cost of the reinforcement itself can be prohibitive in many circumstances. Therefore, what is needed is a method to construct these berms that allows for economical construction and that utilizes material that can generate the revenue necessary to cover the bulk of the cost of the entire berm while being environmentally sound and regulatory agency acceptable.

BRIEF SUMMARY OF THE INVENTION

In one embodiment of the invention, a berm comprises fill material having a sloped face portion, a plurality of reinforcing members disposed within the fill material, and an impermeable membrane encapsulating the fill material. The impermeable membrane is impermeable to fluid and comprises a plurality of joined impermeable membrane segments. The sloped face portion is encapsulated by at least a portion of each of two or more of the impermeable membrane segments. Where two impermeable membrane segments encapsulating the sloped face portion meet, an upper end portion of a lower one of the impermeable membrane segments extends into the fill material and a lower end portion of an upper one of the impermeable membrane segments overlaps the lower one of the impermeable membrane segments in a shingled fashion.

At least a portion of the upper end portion of the lower one of the impermeable membrane segments that extends into the fill material may sit on top of a portion of one of the reinforcing members.

At least a portion of the upper end portion of the lower one of the impermeable membrane segments that extends into the fill material may be affixed to a portion of one of the reinforcing members.

The upper end portion of the lower one of the impermeable membrane segments that extends into the fill material may comprise a mounded portion adjacent the face portion.

The berm may further comprise a drainage system within the impermeable membrane. The drainage system may comprise a perforated pipe surrounded by a granular fill material.

The fill material may comprise contaminated fill material. The contaminated fill material may comprise one or more of fossil fuel combustion product, fly ash, bottom ash, boiler slag, flue gas desulphurization material, nonhazardous contaminated soil, contaminated crushed glass, contaminated crushed concrete, contaminated crushed asphalt, sand blast grit, foundry sand, properly de-watered dredge spoils, or combinations thereof; and wherein the contaminated fill material is contaminated with one or more of a metal, an acid, a base, a volatile organic compound, a semi-volatile organic compound, a petroleum product, selenium, mercury, lead, boron, cadmium, thallium, a polycyclic aromatic hydrocarbons compound, or combinations thereof.

The impermeable membrane may comprise a geomembrane.

The plurality of reinforcing members may be disposed horizontally within the fill material.

In addition to the berm, as described above, other aspects of the present invention are directed to corresponding methods for building a berm.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
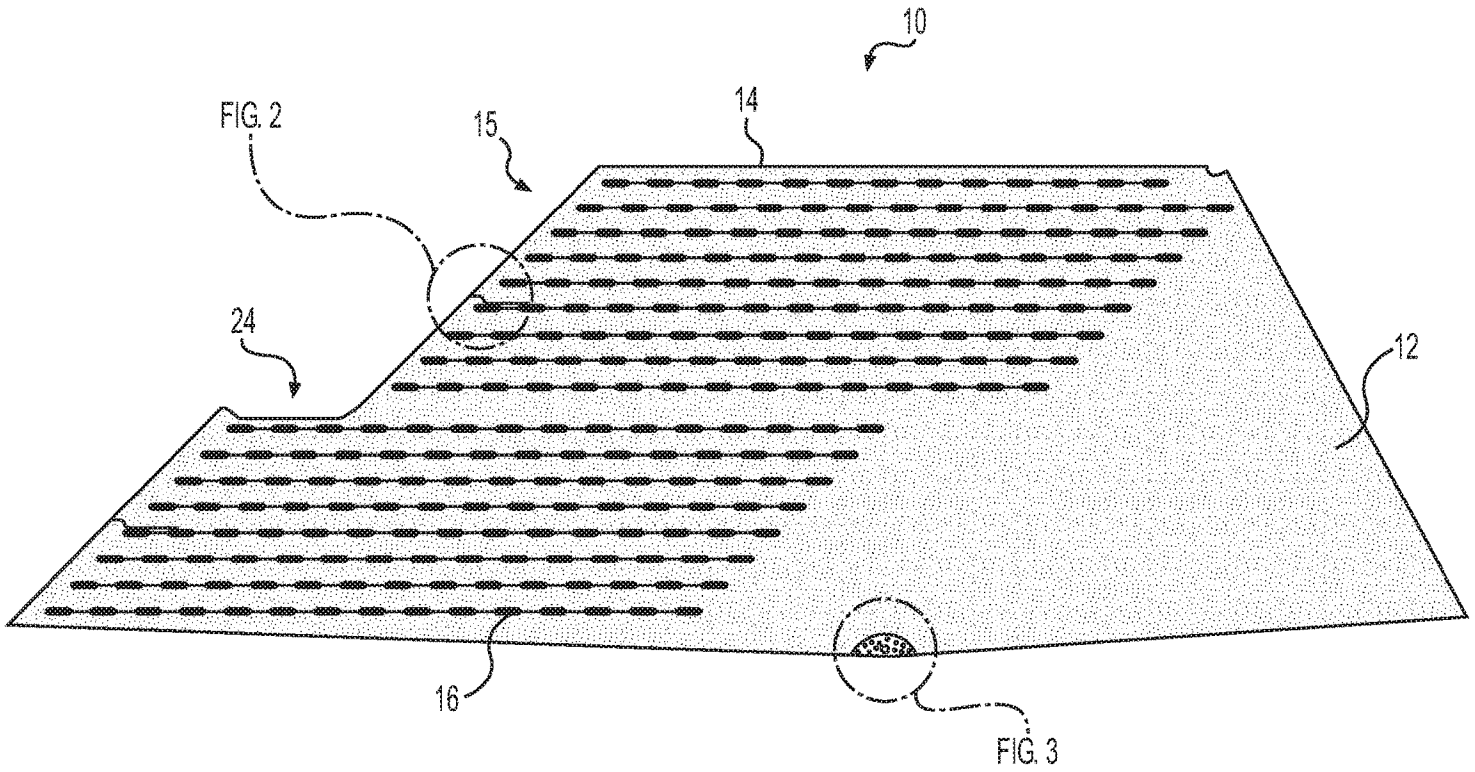
FIG. 1 is a simplified cross-sectional diagram of a berm, in accordance with one embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

The combustion of coal or wood in coal or wood fired power plants produces several materials, including: fly ash, bottom ash, boiler slag, and flue gas desulphurization (FGD) material. Together, these materials represent what is generally referred to as ash or sometimes as FFCPs—Fossil Fuel Combustion Products. These materials are well-documented sources of heavy metal contamination in air, water and on land. Contaminants include selenium, mercury, lead, boron, cadmium, thallium, polycyclic aromatic hydrocarbons compounds, etc. There is an increased awareness and concern regarding the long-term health effects of these materials on both humans and the environment as these contaminants can become mobile if not sequestered properly.

FFCPs generally are a very good material suitable for utilization in embankments, re-enforced embankments, walls, berms, roadways, etc. as they tend to be coarse in nature and offer superior shear strength, possess a high friction angle, and have high bearing capacity. Currently, approximately 53 million tons/year of the 130 million tons/year of FFCPs produced are beneficially used in structural, concrete, wall board and other applications. Upcoming regulatory changes may require that FFCPs be treated as contaminated waste, thereby eliminating many of the uses and producing a pronounced strain on the economy. Additionally, landfill capacity across the United States will be severely stressed to handle the increased demand for simply disposing of these FFCPs. The utilization of FFCPs and other contaminated materials in embodiments of the present invention will offer a suitable, environmentally-, regulatory- and financially-sound alternative use of these types of materials.

In addition, during the development and use of land for many residential, commercial, agricultural, industrial and other purposes, non-hazardous contaminated soils and media (concrete, asphalt, glass, etc.) are created. These materials can be contaminated with metals, acids, bases, volatile and semi-volatile organic compounds, petroleum products, and a host of other contaminates. These materials are well documented sources of contamination in air, water and on land. There is an ongoing and increased awareness and concern of the long term health effects of these materials on both humans and the environment as these elements can become mobile if not sequestered properly as well. These materials, although tainted, are nonetheless valuable for certain beneficial uses, including as a fill (structural or backfill) material in reinforced embankment/berm applications.

The materials (FFCPs and contaminated soils/media) used in embodiments of the invention encompass a very broad entire spectrum of soil and material types and could be characterized as fine grained, coarse grained, homogeneous, non-homogeneous, etc. However characterized, in the embodiments described herein, the material available can be used to construct berms for landfill expansion, roadway and berm construction and are readily available in most locations.

A berm according to embodiments of the present invention may be used for any suitable purpose, such as to create a roadway barrier or levee or to expand the capacity of a landfill. Such a berm is typically constructed on stable ground. Such a berm may be of any suitable height, commonly about thirty to eighty feet tall. Such a berm may be of any suitable length, commonly hundreds or even thousands of feet long.

Referring now to FIG. 1, a simplified cross-sectional diagram of a berm is illustrated in accordance with one embodiment of the present invention. The berm 10 of FIG. 1 comprises structural fill material encapsulated by an impermeable membrane 14. Preferably, the fill material is fully encapsulated. The impermeable membrane is impermeable to fluid and comprises a plurality of joined impermeable membrane segments. Two of the joints between membrane segments are visible in FIG. 1 (on the face portion 15), but such a berm as in FIG. 1 would typically comprise many more segments (whose joints are not shown in FIG. 1). The berm has a face portion 15 that is partly (as illustrated) or entirely (not illustrated) sloped. A level portion 24 may be constructed into the slope of the face portion, such as for an access road or path. A plurality of reinforcing members 16 is disposed within the fill material 12, typically (but not necessarily) horizontally as illustrated. In one exemplary embodiment of the present invention, the reinforcing members comprise uniaxial geogrid from Tensar International Corporation.

The fill material 12 may comprise contaminated fill material. The contaminated fill material can be any suitable waste product that has the desired coarseness, shear strength, high friction angle, and high bearing capacity to function as structural fill. The contaminated fill material should be non-hazardous, but is nonetheless expensive to properly dispose of The contaminated fill material may comprise FFCPs, non-hazardous contaminated soils, contaminated crushed glass, contaminated crushed concrete, contaminated crushed asphalt, sand blast grit, foundry sands, properly de-watered dredge spoils, and combinations of these materials. The contaminated fill material may be contaminated with one or more of a metal, an acid, a base, a volatile organic compound, a semi-volatile organic compound, a petroleum product, selenium, mercury, lead, boron, cadmium, thallium, a polycyclic aromatic hydrocarbons compound, or combinations.

Importantly, the fill material is encapsulated by the impermeable membrane to prevent leachate from the contaminated fill material from escaping the berm (except as purposely removed via a drainage system, as described below).

The impermeable membrane is, when intact, impermeable to fluids. The impermeable membrane used in embodiments of the invention may comprise, for example, a geomembrane, a compacted low permeability clay liner, a geosynthetic clay liner (GCL), geomembrane laminated Geosynthetic Clay Liner, etc., or any suitable liner systems that will typically conform to Subtitle D of the Resource Conservation and Recovery Act (RCRA), conform to an approved equivalent of Subtitle D of RCRA, or conform to a liner and/or cover system requirement of any appropriate regulatory agency. The geomembrane may comprise one of low-density polyethylene (LDPE), high-density polyethylene (HDPE), polyvinyl chloride (PVC), polyurea or polypropylene (PP). Because of the potentially large size of such a berm and the limited size of commercially available geomembranes, the impermeable membrane will typically comprise a plurality of impermeable membrane sections joined with impermeable seams. The plurality of impermeable membrane sections are typically joined using any desirable method of joining such material, including but not limited to extrusion welding, solvent welding, fusion welding, and/or gluing (especially for PVC or PP).

Conventional mechanically stabilized earth (MSE) berms, which are often used for landfill creation/expansion, typically have very steep face portions, with a slope of about 75 degrees or so from a horizontal plane. Such steep slopes enable the berms to be positioned closer to the property boundaries, thereby maximizing the landfill capacity. However, such steep slopes require substantial structure, such as facing baskets tied to reinforcing members, to provide the necessary strength and stability.

Berms of embodiments of the present invention have a much less steep face portion than conventional MSE berms—typically about 30 to about 45 degrees from a horizontal plane. Such a less steep face portion, where space allows, enables a simpler structure. Specifically, berms of embodiments of the present invention do not require facing baskets. Since there are no facing baskets that have to be tied to reinforcing members, it is easier to fully encapsulate the fill material with an impermeable membrane, as the impermeable membrane (which, as described above, comprises a plurality of segments) can surround the entire fill material including the reinforcing members.

Figure 2:
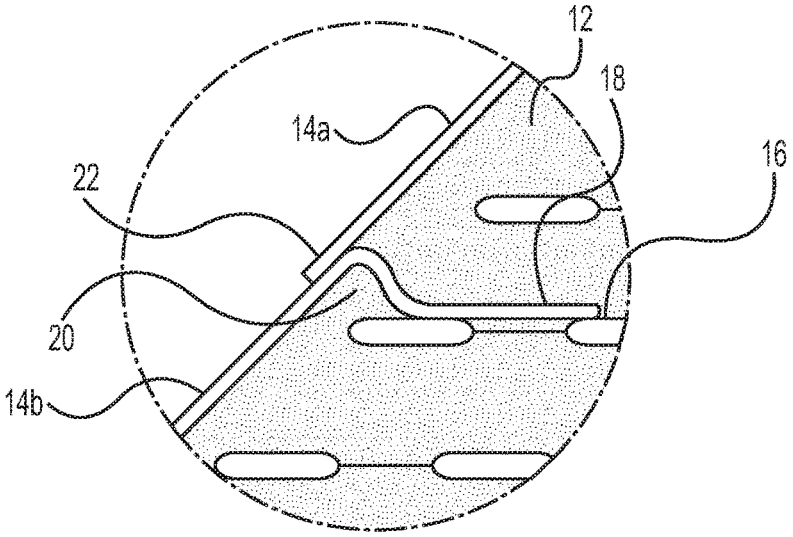
FIGS. 2 and 3 are close-up views of portions of the berm of FIG. 1.

Berms of embodiments of the present invention utilize a novel method of securing the impermeable membrane sections to the sloped face portion of the berm. The sloped face portion is encapsulated by at least a portion of each of two or more of the impermeable membrane segments. FIG. 2 illustrates a close-up view of a joint where two impermeable membrane segments encapsulating the sloped face portion meet. These two impermeable membrane segments are labeled in FIG. 2 as upper impermeable membrane segment 14*a* and lower impermeable membrane segment 14*b*. (The upper impermeable membrane segment 14*a* is so labeled as it is above the lower impermeable membrane segment 14*b*, but not because it is necessarily the uppermost impermeable membrane segment encapsulating the face portion. Similarly, the lower impermeable membrane segment 14*b* is so labeled as it is below the upper impermeable membrane segment 14*a*, but not because it is necessarily the lowermost impermeable membrane segment encapsulating the face portion.) The upper end portion 18 of the lower impermeable membrane segment 14*b* extends into the fill material 12. The lower end portion 22 of the upper impermeable membrane segment 14*a* overlaps the lower impermeable membrane segment 14*b* in a shingled fashion. The overlapping portion of the lower end portion 22 of the upper impermeable membrane segment 14*a* is affixed to the lower impermeable membrane segment 14*b*, typically by welding as described above.

In one exemplary embodiment of the present invention, the spacing of the reinforcing members and the height of the impermeable membrane segments are selected such that the above-described joints on the face portion between an upper and a lower impermeable membrane segment occur at every fourth reinforcing member (although other spacing may be used).

As seen in FIG. 2, at least a portion of the upper end portion 18 of the lower impermeable membrane segment 14*b* sits on top of a portion of one of the reinforcing members 16 (alternatively, at least a portion of the upper end portion 18 of the lower impermeable membrane segment 14*b* may sits below a portion of one of the reinforcing members 16 (not illustrated)). Typically, the weight of the fill material 12 above the upper end portion 18 is enough to retain the upper end portion 18 against the reinforcing member 16, which secures the impermeable membrane to the face portion 15 (in conjunction with the other similar joints (one other such joint is shown in FIG. 1)). Optionally, the upper end portion 18 may be affixed (e.g., welded) to a portion of the corresponding reinforcing member 16.

As seen in FIG. 2, a mounded portion 20 may be formed in the upper end portion 18 and the fill material 12 immediately below. This mounded portion 20 is adjacent the face portion. This mounded portion 20 reduces or eliminates the space where the lower end portion 22 of the upper impermeable membrane segment 14*a* meets the upper end portion 18 of the lower impermeable membrane segment 14*b* to prevent (or minimize) an undesirable accumulation of liquid (which may leach from the fill material 12) at the joint.

Figure 3:
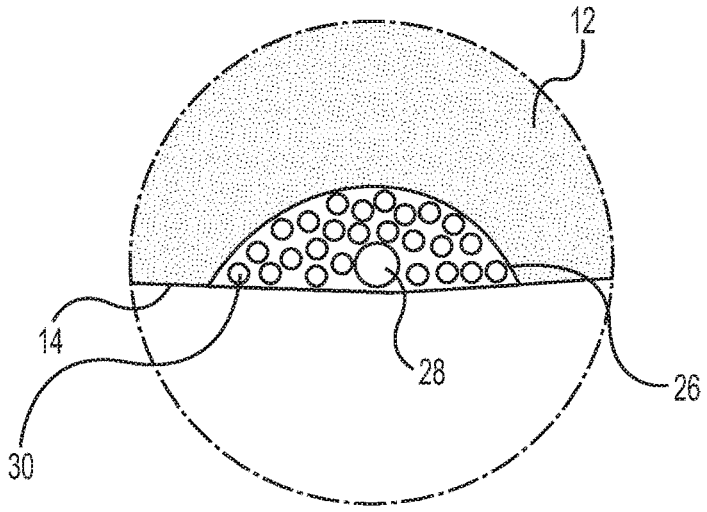

Liquid may be released from the fill material after placement and encapsulation. Therefore, it may be desirable to have an optional drainage system 26 (commonly termed a "toe drain") within the encapsulation to drain away any water that is released from the fill material. The drainage system of FIG. 3 comprises a perforated pipe 28 running along at least a portion of the length of the berm. The pipe 28 is surrounded by a granular fill material 30. An optional plurality of drainage pipes (not illustrated) may each lead substantially perpendicularly from the perforated pipe to an area outside of the berm. The drainage pipes may ultimately lead to a collection tank for later management or may discharge into the landfill's leachate collection and treatment system (if the berm is part of a landfill). Each of the plurality of drainage pipes typically pass through the impermeable membrane via a corresponding boot that is joined to the impermeable membrane and to the corresponding drainage pipe with impermeable seams. A drainage layer (not illustrated) may be adjacent the inside surface of the impermeable membrane (such as along the bottom surface). The drainage layer, which may comprise a geocomposite or any other suitable geosynthetic drainage media, helps channel any water toward the granular fill and the perforated pipe. The drainage system may vary significantly depending on the requirements of the specific implementation of the invention. For example, the drainage system may omit the plurality of drainage pipes. In such an embodiment, the perforated pipe may drain into a gravel conduit which may extend downward into the landfill.

The illustrated berm 10 has a roughly trapezoidal shape with opposing inwardly sloping sides, although the face portion 15 is broken up by a level portion 24 and the bottom surface is not straight either (the bottom surface slopes down in the middle to facilitate drainage). However, a berm of embodiments of the present invention may have any suitable shape, with the only limitation being that the face portion should be angled at less than about 45 degrees relative to the bottom surface of the berm. As an example, the side opposite the face portion 15 may have a portion that slopes outward and downward from the top surface and a portion that slopes upward and outward from the bottom surface.

A berm of embodiments of the present invention may have two opposing angled face portions, each having impermeable membrane segments secured to reinforcing members as described above (not illustrated).

Construction of a berm according to embodiments of the invention generally begins with site improvements, infrastructure relocation, and subgrade preparation. Decommissioning and/or relocation of monitoring wells, gas probes, water/sewer lines, communications and/or electricity cables, stormwater features, and other appurtenances may be necessary. This work will generally be performed prior to subgrade preparation. The existing subgrade along the berm footprint may require cut/fill in order to bring existing grades to the proposed base grade elevations, as specified in the construction drawings. Depending on the foundation conditions, foundation improvements (e.g., deep soil mixing, soil columns) may be required prior to construction of the berm.

To construct the berm, clean structural fill or suitable contaminated soil/media (as described above) (provided the contaminated soil/media can be amended or manipulated to meet the parameters provided by a design engineer and can meet regulatory approval) shall be used as the fill material. To facilitate uniform compaction of both the structural fill material, the construction of the berm shall typically be carried out in the following steps:

1. Place and compact 1.5-foot-thick (although thickness may vary based on the design parameters of the specified berm) lift of structural fill as specified in the construction drawings.

2. Place structural geogrid on structural fill surface of structural fill to at least one foot from face of the berm.

3. Repeat Step 1 at least another three times, as specified in the construction drawings, with each layer setback 1½ feet to form a berm facing of 45-degree angle.

4. A sheet of impermeable geomembrane is placed on top of the structural fill layer with the back edge at least a foot from the face of the berm and temporarily anchored in place. The leading edge of the sheet is then rolled down the face of berm to overlay the previous impermeable geomembrane (if beyond the initial layer) with at least one foot of overlap.

5. The impermeable geomembrane is welded to the previous impermeable geomembrane segment longitudinally down the entire seam to form a continuous joined seam where the two sheets of impermeable geomembrane overlap.

6. Typically, four sections shall be installed following steps 1-5. Depending on the configuration of the wall at a specific site, fewer sections may be constructed at a given time but, typically, no more than four sections will be constructed in one sequence, allowing for facing elements to be installed.

7. Construct the next section of structural fill as outlined in steps 1-6.

8. Repeat steps 7 until the berm is complete.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A berm comprising:

fill material having a sloped face portion;

a plurality of reinforcing members disposed within the fill material; and an impermeable membrane encapsulating the fill material, the impermeable membrane being impermeable to fluid, the impermeable membrane comprising a plurality of joined impermeable membrane segments;

wherein the sloped face portion is encapsulated by at least a portion of each of two or more of the impermeable membrane segments; and wherein, where two impermeable membrane segments encapsulating the sloped face portion meet, an upper end portion of a lower one of the impermeable membrane segments is spaced apart from an upper one of the impermeable membrane segments and thereby extends into the fill material and a lower end portion of the upper one of the impermeable membrane segments overlaps the lower one of the impermeable membrane segments in a shingled fashion.

2. The berm of claim 1, wherein at least a portion of the upper end portion of the lower one of the impermeable membrane segments extending into the fill material sits on top of a portion of one of the reinforcing members.

3. The berm of claim 1, wherein at least a portion of the upper end portion of the lower one of the impermeable membrane segments extending into the fill material is affixed to a portion of one of the reinforcing members.

4. The berm of claim 1, wherein the upper end portion of the lower one of the impermeable membrane segments extending into the fill material comprises a mounded portion adjacent the face portion.

5. The berm of claim 1, further comprising a drainage system within the impermeable membrane.

6. The berm of claim 5, wherein the drainage system comprises a perforated pipe surrounded by a granular fill material.

7. The berm of claim 1, wherein the fill material comprises contaminated fill material; and wherein the contaminated fill material comprises one or more of fossil fuel combustion product, fly ash, bottom ash, boiler slag, flue gas desulphurization material, nonhazardous contaminated soil, contaminated crushed glass, contaminated crushed concrete, contaminated crushed asphalt, sand blast grit, foundry sand, properly de-watered dredge spoils, or combinations thereof; and wherein the contaminated fill material is contaminated with one or more of a metal, an acid, a base, a volatile organic compound, a semi-volatile organic compound, a petroleum product, selenium, mercury, lead, boron, cadmium, thallium, a polycyclic aromatic hydrocarbons compound, or combinations thereof.

8. The berm of claim 1, wherein the impermeable membrane comprises a geomembrane.

9. The berm of claim 1, wherein the plurality of reinforcing members are disposed horizontally within the fill material.

10. The berm of claim 1, wherein a portion of one or more of the plurality of reinforcing members is disposed between the upper end portions of adjacent impermeable membrane segments.

11. The berm of claim 1, wherein a portion of each of the plurality of reinforcing members is disposed between the upper end portions of adjacent impermeable membrane segments.

12. A method of creating a berm, the method comprising:

disposing a plurality of reinforcing members within fill material having a sloped face portion; and encapsulating the fill material with an impermeable membrane, the impermeable membrane being impermeable to fluid, the impermeable membrane comprising a plurality of joined impermeable membrane segments;

wherein the sloped face portion is encapsulated by at least a portion of each of two or more of the impermeable membrane segments; and wherein, where two impermeable membrane segments encapsulating the sloped face portion meet, an upper end portion of a lower one of the impermeable membrane segments is spaced apart from an upper one of the impermeable membrane segments and thereby extends into the fill material and a lower end portion of the upper one of the impermeable membrane segments overlaps the lower one of the impermeable membrane segments in a shingled fashion.

13. The method of claim 12, wherein at least a portion of the upper end portion of the lower one of the impermeable membrane segments extending into the fill material sits on top of a portion of one of the reinforcing members.

14. The method of claim 12, wherein at least a portion of the upper end portion of the lower one of the impermeable membrane segments extending into the fill material is affixed to a portion of one of the reinforcing members.

15. The method of claim 12, wherein the upper end portion of the lower one of the impermeable membrane segments extending into the fill material comprises a mounded portion adjacent the face portion.

16. The method of claim 12, further comprising:

disposing a drainage system within the impermeable membrane.

17. The method of claim 16, wherein the drainage system comprises a perforated pipe surrounded by a granular fill material.

18. The method of claim 12, wherein the fill material comprises contaminated fill material; and wherein the contaminated fill material comprises one or more of fossil fuel combustion product, fly ash, bottom ash, boiler slag, flue gas desulphurization material, nonhazardous contaminated soil, contaminated crushed glass, contaminated crushed concrete, contaminated crushed asphalt, sand blast grit, foundry sand, properly de-watered dredge spoils, or combinations thereof; and wherein the contaminated fill material is contaminated with one or more of a metal, an acid, a base, a volatile organic compound, a semi-volatile organic compound, a petroleum product, selenium, mercury, lead, boron, cadmium, thallium, a polycyclic aromatic hydrocarbons compound, or combinations thereof.

19. The method of claim 12, wherein the impermeable membrane comprises a geomembrane.

20. The method of claim 12, wherein the plurality of reinforcing members are disposed horizontally within the fill material.

21. The method of claim 12, wherein a portion of one or more of the plurality of reinforcing members is disposed between the upper end portions of adjacent impermeable membrane segments.

22. The method of claim 12, wherein a portion of each of the plurality of reinforcing members is disposed between the upper end portions of adjacent impermeable membrane segments.

* * * * *